US005185894A

United States Patent [19]

Bastert et al.

[11] Patent Number: 5,185,894

[45] Date of Patent: Feb. 16, 1993

[54] APPARATUS FOR SHIFTING PATIENTS TO AND FROM A BED

[75] Inventors: Carl-Christian Bastert, Gaggenau; Armin Helgert, Oetigheim, both of Fed. Rep. of Germany

[73] Assignee: Stierlen-Maquet AG, Rastatt, Fed. Rep. of Germany

[21] Appl. No.: 793,829

[22] Filed: Nov. 18, 1991

[30] Foreign Application Priority Data

Nov. 22, 1990 [EP] European Pat. Off. ..... 90122343.8
Dec. 21, 1990 [DE] Fed. Rep. of Germany ..... 4041335

[51] Int. Cl.[5] ..... A61G 7/08
[52] U.S. Cl. ..... 5/81.1; 74/89.22
[58] Field of Search ..... 5/81.1, 86.1, 88.1; 74/89.22, 89.21; 464/160; 474/112

[56] References Cited

U.S. PATENT DOCUMENTS 716,886 12/1902 Goode ..... 5/81.1
3,593,351 7/1971 Dove ..... 5/81.1
3,724,005 4/1973 Stevens ..... 5/81.1
3,760,435 9/1973 Jardine ..... 5/81.1
3,947,902 4/1975 Conde ..... 5/81.1
4,156,946 6/1979 Attenburrow ..... 5/81.1
4,669,137 6/1987 Schnelle ..... 5/81.1
4,858,261 8/1989 Iura ..... 5/81.1

*Primary Examiner*—Renee S. Luebke
*Assistant Examiner*—F. Saether

[57] ABSTRACT

In an apparatus for shifting patients and having a mobile frame supported on rollers, a cantilevered platform arranged on the frame, and a transport band (44) which is movable by means of a drive mechanism in both directions and which proceeding from a first winding roll supported in the frame extends over the upper side of the platform, around the free longitudinal edge of the platform and along the bottom side of the platform to a second winding roll supported in the frame and onto which it is windable, both winding rolls (26, 28) are constantly coupled with the drive mechanism (68, 70, 72) with rotary play being provided between each winding roll (26, 28) and the drive mechanism (68, 70, 72). Each winding roll (26, 28) can be biased in its winding direction.

8 Claims, 5 Drawing Sheets

APPARATUS FOR SHIFTING PATIENTS TO AND FROM A BED

Figure 1:
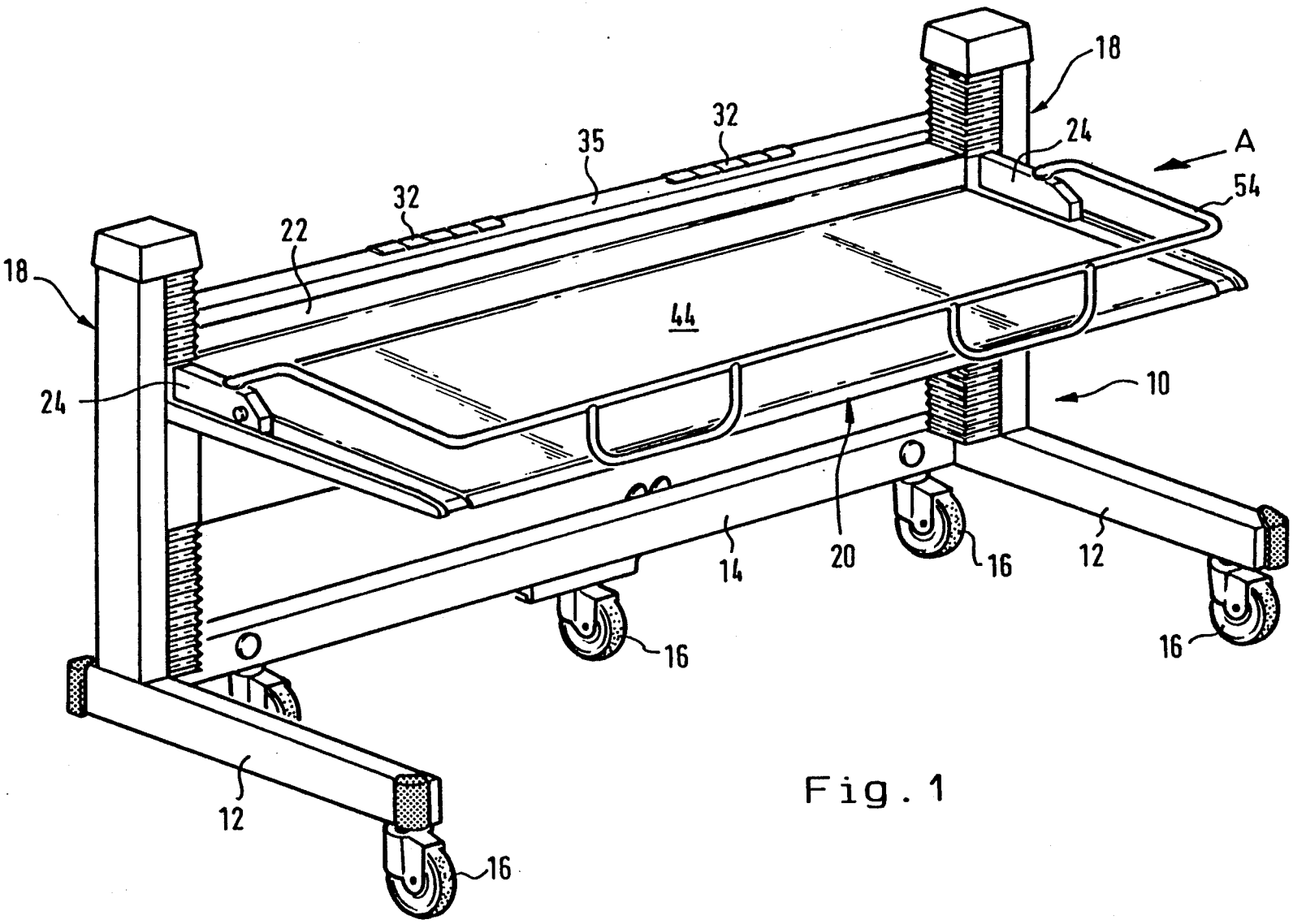

The invention concerns a patient shifting apparatus having a mobile frame supported on rollers, a cantilevered platform arranged on the frame, and a transport band movable in both directions by a drive mechanism. and which proceeding from a first winding roll supported by the frame, extends over the upper side of the platform, over the free longitudinal edge of the platform and along the bottom side of the platform to a second winding roll supported by the frame and onto which it is windable.

One such device is described in old German Patent Application No. P 39 28 622. In such a device the problem arises that upon changing the winding direction, because of the difference in diameter between the full winding roll and the empty winding roll, less band will be taken up on the empty winding roll than is paid out from the full roll so long as both rolls are driven in synchronism at the same rotary speed. This therefore leads to the band between the winding rolls becoming saggy and creased. Because of the formation of the creases the band can be damaged. To avoid these disadvantages one previously had to provide couplings in the drive for the rolls, so that only the winding roll was driven and the other one pulled. This however makes the drive mechanism complicated because of the required couplings.

The invention has as its object the provision of a device of the previously mentioned kind in which with a simple drive apparatus a sagging and creasing of the band during change of the winding direction can be avoided.

This problem is solved in accordance with the invention in that both winding rolls are constantly coupled with the drive mechanism and in that a limited rotary play is provided between each winding roll and the drive mechanism.

The rotary play makes possible a relative motion between each winding roll and the drive mechanism so that the band dispensing roll is not positively driven but can drag. Upon a change in direction the drive mechanism moves through the rotary play and positively drives the previously drawn roll. The rotary play must naturally be so dimensioned that the length difference between the band taken up onto the empty winding roll and the band dispensed from the full winding roll can be captured.

According to a preferred embodiment, which is easy to realize, the winding rolls are each supported on a shaft with the shaft being coupled to the drive mechanism and with the angular rotation of each winding roll with respect to its shaft being limited by stops. The tensioning of the band can be further improved if each of the winding rolls is biased in its winding direction. For this a spring for generating the bias can be arranged between each winding roll and its shaft.

In a device for supporting patients known from German Gebrauchsmuster 87 04 343 the platform is movable relative to the frame with the band being movable either together with the platform or relative to it. A disadvantage of all embodiments of such devices, so called bed changers, having only one transport band is that upon pushing the platform under the patient and simultaneously receiving the patient on the platform the band portion running over the underside of the platform rubs against the bed sheet and displaces it. This makes difficult a frictionless receiving of the patient onto the platform. During the unloading of the patient onto the bed the reverse process takes place. Bed changers are already known which use two platforms lying over one another and over each of which one band runs. By suitable control of the two bands the above-described disadvantage can be avoided. But this solution is relatively expensive and complicated both with respect to its mechanical aspects as well as with respect to its control aspects.

The solution according to the invention provides that the transport band extends from the platform underside over the second winding roll to a reversing edge located near and below the free longitudinal edge of the platform, that it passes over this free longitudinal edge back to the second winding roll, and that the band ends are so run onto the two winding rolls that these during loading and unloading winding rotate in the same direction.

The previously described solution uses only one band, and also only one drive mechanism is required for driving one of the two winding rolls upon loading winding or unloading winding. Despite this solution being simple both constructionwise and controlwise, it is also one that permits the same advantages to be achieved which previously were achieved only with two separate bands and platforms. Because of the inventive guiding of the band the lower stretch of the band which comes into contact with the patient bed or bed sheet and the upper stretch of the band which runs over the upper side of the platform and which is to receive the patient always move together in the same direction regardless of the winding direction. This permits the above-described disadvantages to be reliably avoided. The platform can be pushed between the patient and the bed sheet with only small resistance because of the movement of the upper and lower stretches of the band, with the bed sheet not being shifted by rubbing on the lower stretch of the band.

To keep the band as flat as possible around the platform the reversing edge preferably is formed by a bar received in a recess on the underside of the platform and connected with the platform. In this way the entire arrangement is only slightly thicker than the platform itself.

The platform itself can be arranged for height adjustment on the frame so that it can be set for use with different bed heights.

For pushing the bed changer a handrail is fastened to the frame on the side remote from the platform and extending parallel to the platform. For easy operation, in accordance with the invention, an operating element for the drive control is arranged in the handrail.

Further features and advantages of the invention will be apparent from the following description, which in connection with the accompanying drawings explains the invention in relation to an exemplary embodiment. The drawings show:

FIG. 1—A perspective total view of an apparatus embodying the invention.

Figure 2:
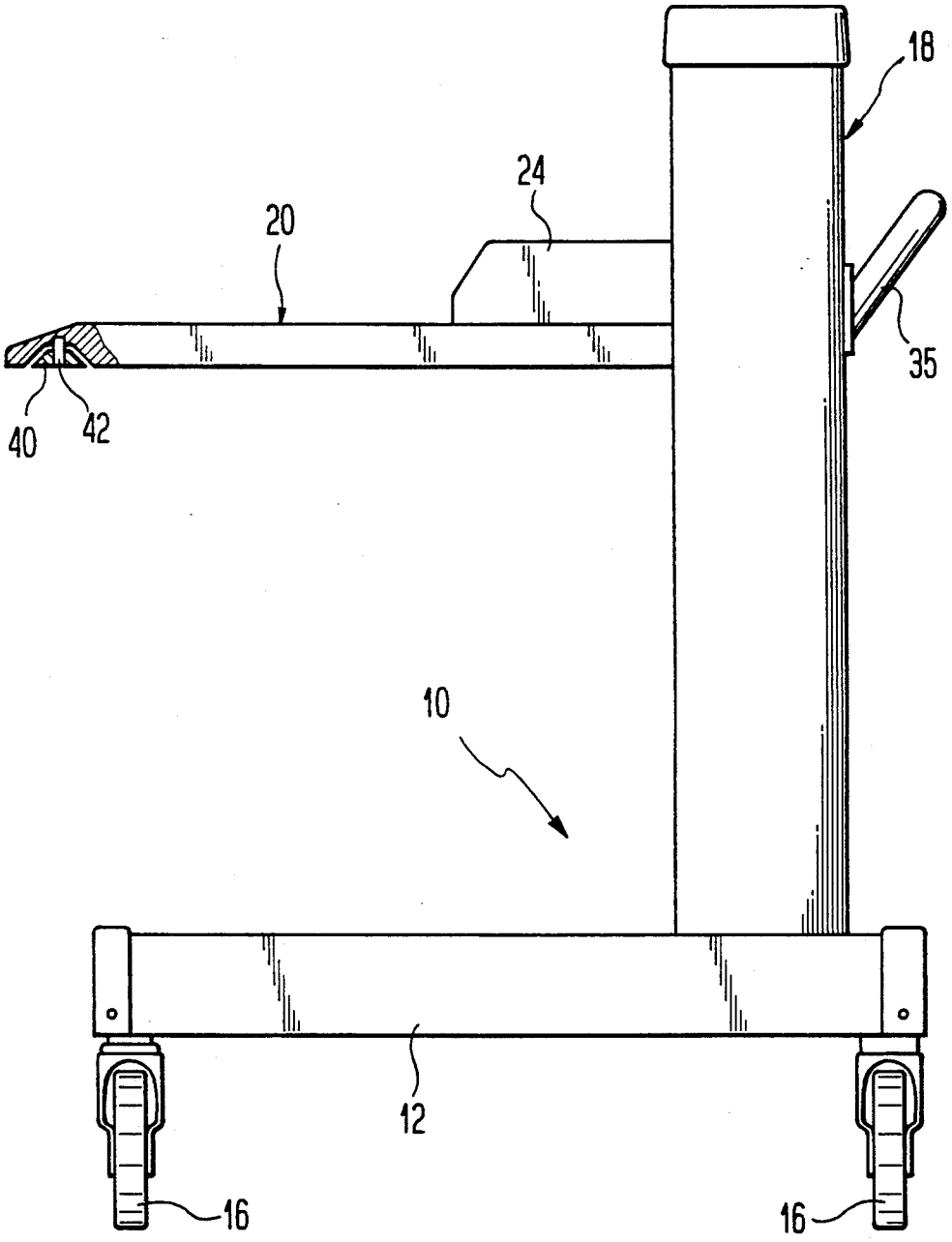

FIG. 2—A side view of the apparatus of FIG. 1 taken in the direction of the arrow A of FIG. 1.

Figure 3:
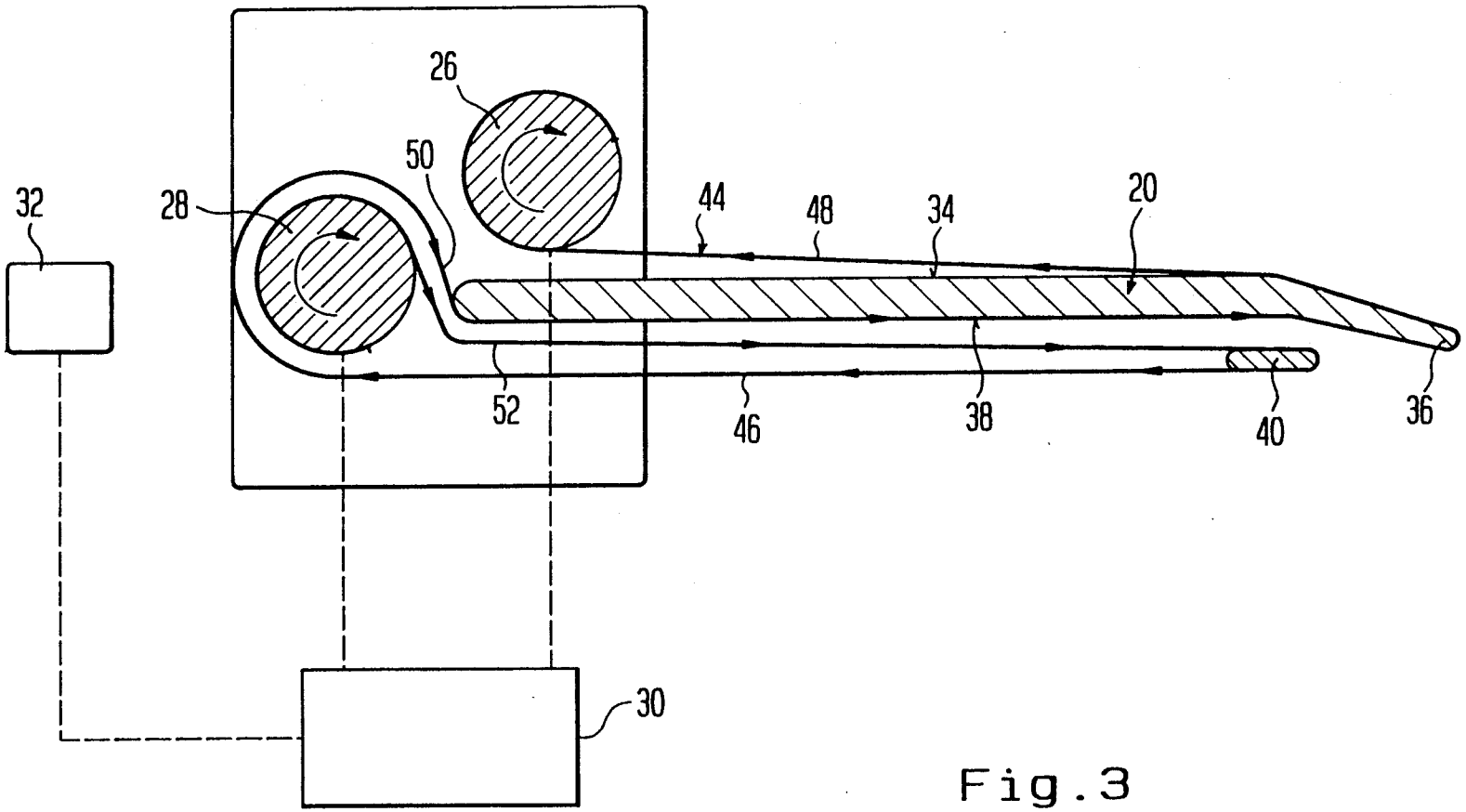

FIG. 3—A schematic view of the drive and band guide for explaining the function of the apparatus embodying the invention.

Figure 4:
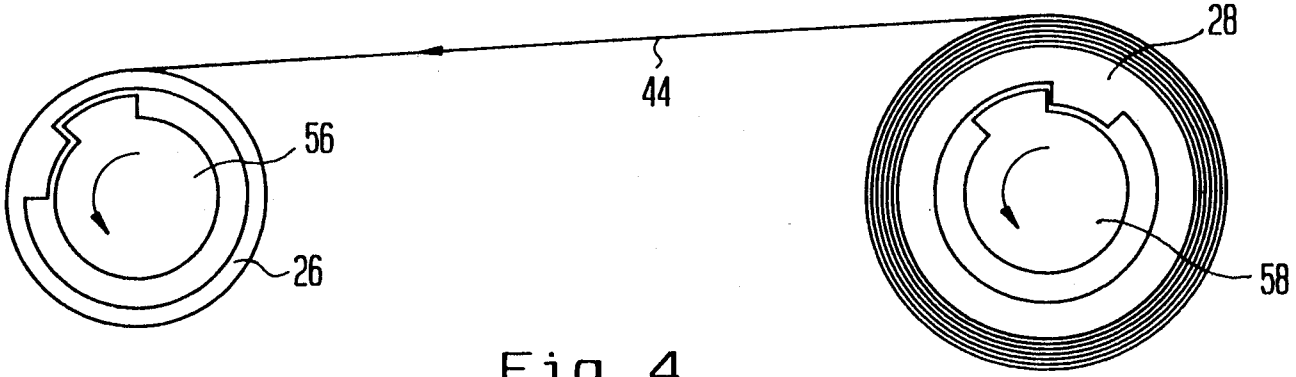
Figure 5:
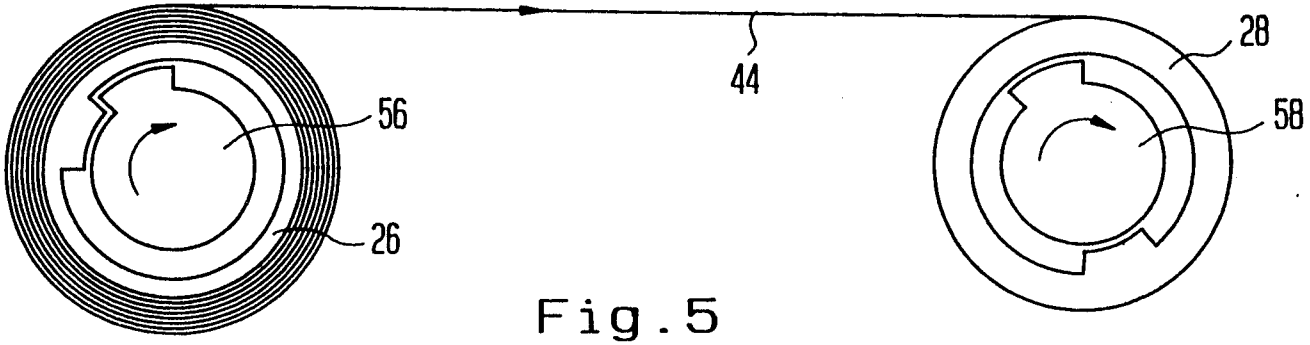

FIGS. 4 and 5—Two schematic illustrations of the winding rolls alone showing respectively two different winding conditions.

Figure 6:
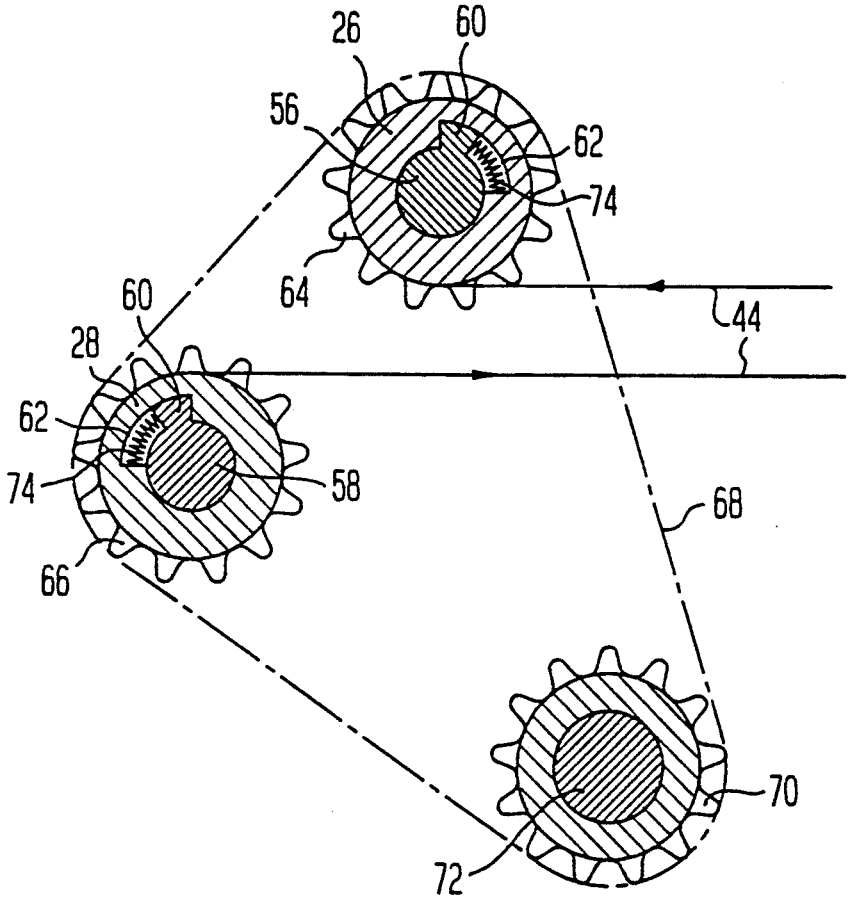

FIG. 6—A schematic side sectional view of the winding rolls and a drive roll.

The mobile bed changer illustrated in FIGS. 1 and 2 for the transport and shifting of patients includes a frame illustrated generally at 10 with two short horizontal cross beams 12 and a longitudinal beam 14 connecting them together, each of which beams is supported on rollers 16. Arranged at the connecting points of the cross beams 12 with the longitudinal beam 14 are vertical columns 18 with which is associated in cantilevered and height adjustable fashion a platform indicated generally at for receiving and for transporting a patient. The platform 20 is driven for vertical adjustment at one of the columns 18 and has fastened to it a longitudinal beam 22 and two cross beams 24. Since the height adjustment of the platform 20 can take place in a desired way known in itself, it is not here described in further detail.

Rotatably supported inside the columns 18 and the longitudinal beam 22 are two winding rolls 26 and 28 which are connected by a non-illustrated chain drive with a drive mechanism 30 illustrated only schematically in FIG. 3. This drive mechanism is controllable by an operator's keyboard 32 arranged on the rear side of the handrail 35 of the bed changer running parallel to the longitudinal direction of the platform 20 so that it can be easily operated by the operating person.

According to the illustration of FIG. 3 one end of a band is connected with the upper winding roll 26 with the band extending from this roll 26 over the upper side 34 of the platform 20, over the free edge 36 of the platform 20 to the platform bottom side 38. From there the band runs back to the columns 18 and proceeding from the frame sided end of the platform is guided over the second winding roll 28 back again in the direction toward the free platform edge 36. Near the free platform edge 36 and below the platform 20 is a reversing bar 40 running parallel to the free platform edge 36 and which is fastened at its longitudinal ends to the platform 20 by bolts 42 (FIG. 2). The transport band 44 is guided over the reversing bar 40 and then back to the second winding roll 28, onto which it is directed in the winding direction opposite to that of the winding roll 26.

If for receiving a patient the transport band 44 is driven in the direction given by the arrows, in which case the winding roll 26 is driven, it will be understood that the lower stretch 46 and the upper stretch 48 of the transport band move in the same sense as also do the intermediate sections 50 and 52 of the transport band which stand in engagement with one another. If the direction of rotation is reversed the same running relationships occur but in the opposite directions. If for receiving the patient the platform is pushed between the patient and the bed sheet with a suitable speed no relative movement takes place between the transport band and the bed sheet so that the sheet is not shifted. The platform can be pushed under the patient without large resistance. The same relationships occur in the reversed rotational direction during unloading of the patient.

In FIG. 1 a guard rail is indicated at 54 which for receiving a patient can be pivoted upwardly and which serves to hinder falling of the patient from the platform. This rail is not illustrated in FIG. 2.

In FIGS. 4 to 6 the two winding rolls 26 and 28 can be seen similarly as in FIG. 3. These are formed from hollow cylinders with each being freely rotatably supported on a shaft 56 or 58. Each shaft is connected with a radial extension 60 which is received in a sector-shaped recess 72 in the associated winding roll 26 or 28. The angular range over which the sector-shaped recess 62 extends determines a rotary play between each winding roll 26 or 28 and its shaft 56 or 58.

Each of the shaft 56, 58 is rotatably rigidinly connected with a sprocket 64 (FIG. 6) or 66 and is driven by a chain 68 which runs over a sprocket 70 rotatably rigidly connected with the drive shaft 72 of a not otherwise illustrated drive mechanism.

In the special embodiment of FIG. 6 each winding roll 26, 28 is biased in its winding direction by a schematically indicated spring 74. For the winding roll 26 this rotary direction is the clockwise direction and for the winding roll 28 this rotary direction is the counterclockwise direction. For the generation of this bias each spring can also be chosen to be a suitable torsion spring. This spring is not however absolutely necessary as shown by the embodiment of FIGS. 4 and 5.

This arrangement has the following object. Assume that the band has been rolled up onto one of the winding rolls. Then the diameter of this winding roll including the wound band is larger than the diameter of the other winding roll. If now the winding direction is reversed with synchronous and same direction drive of the two shafts 56, 58 the band take-up on the windup roll will be smaller than the band output from the band delivery roll. This in turn leads to the band between the two winding rolls sagging or forming creases and the band can easily be damaged. This is avoided by the solution of the invention.

FIG. 4 shows the winding rolls 26, 28 and the shafts 56, 58 in their assembled and end positions. If band 44 is wound onto the left roll 26 the right roll 2 despite the synchronous drive of the shaft 58 drags because of the rotary play between the shaft 58 and the roll 28. The band remains stretched. In FIG. 5 the same process takes place in the reverse direction.

In the embodiment according to FIG. 6 the spring arranged between each winding roll and its associated shaft because of the provided rotary play has the effect that the winding roll is always biased in the winding direction. So long as the rotary play is large enough a sagging or creasing of the band is avoided.

We claim:

1. An apparatus for shifting patients to and from a bed, said apparatus comprising a mobile frame supported on rollers, a platform having an upper side and an underside and arranged in cantilevered fashion on said frame so as to have a free longitudinal edge spaced from said frame, a transport band with two ends, first and second winding rolls supported by said frame onto and from each of which winding rolls portions of said transport band are windable and unwindable, each of said two ends of said band being connected to a respective one of said winding rolls with said band proceeding from said first winding roll over said upper side of the platform and over said free longitudinal edge and from there along said platform underside to said second winding roll, and a drive mechanism for said first and second winding rolls, said drive mechanism including a rotary drive member, and a means for connecting each of said first and second winding rolls to said drive member so that each of said winding rolls is constantly operatively connected with the drive member and so that a limited amount of rotary play is provided between each winding roll and the drive member.

2. A device according to claim 1 further characterized in that each of said winding rolls is rotatably supported on a shaft driven in unison with said drive member, and stop means between said shaft and said winding roll for limiting the angular rotation of said winding roll with respect to said shaft so as to provide said rotary play.

3. An apparatus according to claim 2 further characterized in that between each winding roll and its shaft is arranged a spring for biasing said winding roll relative to said shaft in the direction at which it winds said transport band onto itself.

4. An apparatus according to claim 1 further characterized by means for biasing each of said winding rolls relative to said drive member in the direction at which it winds said transport band onto itself.

5. An apparatus according to claim 1 further characterized in that said transport band is guided from said platform underside over said second winding roll to a reversing edge arranged near and below said free longitudinal edge of the platform and over said edge to said second winding roll, and in that said transport band so runs onto said winding rolls that during winding of said transport belt onto either one of said rolls both of said rolls rotate in the same direction.

6. An apparatus according to claim 5 further characterized in that said reversing edge is formed by a bar which lies in a recess on the underside of said platform and is connected with said platform.

7. An apparatus according to claim 1 further characterized in that said platform is adjustable in height relative to said frame.

8. An apparatus according to claim 1 further characterized in that a handrail is fastened to said frame on the side remote from said platform and extends parallel to said platform, and an operating element for a drive control for said drive mechanism arranged on said handrail.

* * * * *